US012808267B2

(12) United States Patent
Geldard et al.

(10) Patent No.: US 12,808,267 B2
(45) Date of Patent: Nov. 24, 2026

(54) CONNECTOR ASSEMBLY FOR USE WITH MICROTUNNELING APPARATUS

(71) Applicant: OptionX Holdings Pty Ltd, Burleigh Waters (AU)

(72) Inventors: Gregory Alan Geldard, Mount Lofty (AU); Albert Fourie, Burleigh Waters (AU); Darrin Breeden, Burleigh Waters (AU); Stuart Harrison, Burleigh Waters (AU); Adrian Sneddon, Burleigh Waters (AU)

(73) Assignee: OPTIONX HOLDINGS PTY LTD, Burleigh Waters (AU)

( * ) Notice: Subject to any disclaimer, the term of this patent is extended or adjusted under 35 U.S.C. 154(b) by 0 days.

(21) Appl. No.: 18/872,998

(22) PCT Filed: Jun. 9, 2023

(86) PCT No.: PCT/AU2023/050515
§ 371 (c)(1),
(2) Date: Dec. 9, 2024

(87) PCT Pub. No.: WO2023/235939
PCT Pub. Date: Dec. 14, 2023

(65) Prior Publication Data

US 2025/0361777 A1 Nov. 27, 2025

(30) Foreign Application Priority Data

Jun. 9, 2022 (AU) ..... 2022901586

(51) Int. Cl.
*E21B 17/046* (2006.01)
*E21B 3/04* (2006.01)
(Continued)

(52) U.S. Cl.
CPC ..... *E21B 17/046* (2013.01); *E21B 7/28* (2013.01); *E21B 10/28* (2013.01); *E21B 3/045* (2013.01); *E21B 7/046* (2013.01)

(58) Field of Classification Search
CPC ..... E21B 17/046; E21B 17/0465; E21B 7/28; E21B 7/046; E21B 3/045; E21B 10/28
See application file for complete search history.

(56) References Cited

U.S. PATENT DOCUMENTS

2009/0301783 A1 12/2009 Salins
2010/0206635 A1* 8/2010 Harrison ..... E21D 9/093 175/344

(Continued)

FOREIGN PATENT DOCUMENTS

RU 2114977 C1 7/1998
WO 2017131649 A1 8/2017
WO 2023183989 A1 10/2023

OTHER PUBLICATIONS

International Search Report and Written Opinion for Application No. PCT/AU2023/050515 dated Aug. 2, 2023 (10 pages).

(Continued)

*Primary Examiner* — Nicole Coy
*Assistant Examiner* — Nicholas D Wlodarski
(74) *Attorney, Agent, or Firm* — Michael Best & Friedrich LLP

(57) ABSTRACT

This invention relates to a connector assembly 21 for use with a microtunneling apparatus 1 including a drill string 13 and a cutting head 6. The drill string 13 including a drive shaft 23 which is rotatable from a proximal end of the drill string 13 by drive apparatus 2 located in a drive pit 3. The connector assembly 21 includes a latch mechanism 42 that is adjustable between a lock condition and a release condition from the proximal end of the drill string 13.

9 Claims, 12 Drawing Sheets

(51) Int. Cl.

| | |
|---|---|
| ***E21B 7/04*** | (2006.01) |
| ***E21B 7/28*** | (2006.01) |
| ***E21B 10/28*** | (2006.01) |

(56) References Cited

U.S. PATENT DOCUMENTS

| | | | | |
|---|---|---|---|---|
| 2011/0266062 | A1* | 11/2011 | Shuman, V | E21B 21/12 175/173 |
| 2015/0083496 | A1* | 3/2015 | Winslow | E21B 4/02 175/57 |
| 2019/0003264 | A1* | 1/2019 | Swadi | E21B 29/002 |

OTHER PUBLICATIONS

International Preliminary report on Patentability for Application No. PCT/AU2023/050515 dated Apr. 30, 2024 (7 pages).

* cited by examiner

CONNECTOR ASSEMBLY FOR USE WITH MICROTUNNELING APPARATUS

TECHNICAL FIELD

This invention relates to a connector assembly for use with microtunneling apparatus, and a microtunneling apparatus including such a connector. More specifically the connector assembly is for use between a drill string with a cutting head of the microtunneling apparatus. The connector assembly has a particular application for use between a drill string and a reamer, and it will be convenient to hereinafter describe the invention with reference to this particular application. It ought to be appreciated however that the invention may have other applications in relation to other cutting heads.

BACKGROUND OF INVENTION

The term microtunneling as used throughout this specification is a reference to drilling or boring a non-vertical hole, generally with a diameter of no greater than 1500 mm, where the operator is not required to enter the hole. It will be convenient to hereinafter describe the invention within this reference.

The provision of services such as as telecommunications, gas, water supply, stormwater, sewerage, data, and electricity might traditionally involve excavating a trench, laying the services and backfilling the trench. This might have been convenient where the trench is relatively shallow and where there is no existing infrastructure on, for example, a "green fields" site. However, as the depth of the trench increases, it can be difficult to provide machinery at a cost-effective rate to trench to the required depth. Furthermore, if there is other existing infrastructure that would be adversely impacted by an open trench, such as disruption or damage to major roadways or existing services, other methods of creating a conduit must be considered.

One other such method is microtunneling which will generally involve drilling apparatus having a drill head located at the end of a drill string that is rotated to drill a hole through the ground to produce the micro tunnel. The drill string is formed from a number of segments which each include a solid drive shaft that transfers torque from a drive apparatus on the surface, or at the bottom of a vertical drive pit, to the drill head underground. The drill string can also include a channel to accommodate operating lines, such as hydraulic pipes and communication cables, from the drive pit to the cutting head. The drill string can also include a spoil removal conduit through which the swarf and fluid adjacent the rear of the drill head, can be moved back to the drive pit.

It ought to be appreciated that the energy required to produce the micro tunnel is in part a function of the amount of spoil to be removed, so that the larger the tunnel the greater the energy required. While drilling is an option, it can be difficult to accurately direct a drill head. Deviations from a preferred line can result in spoil being removed unnecessarily. One method for minimising the unnecessary removal of spoil, is to drill a pilot hole and enlarge the pilot hole with a reamer assembly. The pilot hole can be relatively small, and so long as the pilot hole has been directed generally within section of spoil to be removed by the reamer, reaming will remove the spoil relatively efficiently.

A reamer assembly will generally utilise the drive shaft in the drill string to rotate the reamer's cutting head, while the drill string is under tension as it draws the reamer assembly back through the pilot hole. The torque supplied by the drive shaft to the reamer cutting head will be the same as that supplied to the drill head, however the working face that the reamer cutting head engages will be a greater diameter than the pilot hole. Accordingly, the resistance created by the cutting head engaging the working face, acting against the torque supplied by the drive apparatus, can cause greater stress on the drive shaft. Where the cutting head is working in hard ground, this increase in stress can cause the drive shaft to fail.

Traditionally where a failure occurs, it is necessary to retract the reamer out of the bore hole back to a thrust pit which is remote from the drive pit. The reamer can be disconnected from the drill string in the thrust pit, and the drill string can be retracted out of the pilot hole through the drive pit. The string segment with the failed drive shaft can be replaced, and then the process is reversed. The drill string can be reinserted through the pilot hole, and through the bore hole to the thrust pit so that it can be reattached to the reamer. Finally, the drill string can draw the reamer back to the working face so reaming out the bore hole can continue. It ought to be appreciated that replacing a broken drive shaft in this manner causes considerable down time which impacts on the efficiency and profitability for the operator.

The drill string can in some situations come under stress and it is unclear to the operator whether the stress is occurring as a result of the drill string or the reamer head. More specifically the jacking pressure may increase as a result of the reamer head cutting through harder ground at the working face, or the drill string itself developing greater friction with the pilot hole. Generally, the solution adopted by the operator for either problem is to slow down the speed of the reamer head, as the drive shaft can fail if it is as a result of harder ground at the working face. However, if the result of the increase in jacking pressure was in fact due to pilot hole friction, it would be unnecessary to slow down the speed of the cutter head. This can result in the operator taking longer than necessary to ream out the pilot hole which will have an impact on productivity.

The invention aims to address one or more of the forgoing problems.

A reference herein to a patent document or other matter which is given as prior art is not to be taken as an admission that that document or matter was, in Australia, known or that the information it contains was part of the common general knowledge as at the priority date of any of the claims.

SUMMARY OF THE INVENTION

According to one aspect of this invention there is provided a connector assembly for use with microtunneling apparatus including a drill string having a drive shaft that is rotatable about a working axis from a proximal end of the drill string, an operating line extending from the proximal end of the drill string along the length of the drill string, and a cutting head at a distal end of the drill string, the cutting head having a plurality of cutting elements for rotation with the drive shaft about the working axis and a plurality of locating elements spaced from the working axis, the connector assembly including a housing with a proximal end adapted for location at distal end of the drill string, and a distal end of the housing being adapted to interact with the locating elements of the cutting head, a latch mechanism at the distal end of the housing which is spaced from the working axis, the latch mechanism for connection to the operating line so as to be adjustable between a lock condition and a release condition from a proximal end of the drill string, so that in use the connector assembly engages cutter head when in the locked condition to move with the drill string and the connector assembly is disengaged from the cutting head when in the release condition to move the drill string relative to the cutting head.

The connector assembly preferable defines a void, or at least an aperture for accommodating each said locating element of the cutting head, and a detent associated with each aperture for interacting with each locating element, each detent is adjustable between an active position and an inactive position which corresponds with the latch mechanism adopting the lock condition and release condition respectively. Each detent may be adapted to move linearly between the active position and the inactive position, however other forms of movement such as pivoting, so as to engage the locating elements may also be possible. A hydraulic ram for each detent may be used such that when activated it move each detent between the inactive position and the active position, however other forms of actuation devices for moving the detent may be possible. If a hydraulic ram is used it is preferred that each hydraulic ram includes two single-action cylinders, each single action cylinder being operable to push the detent only and being arranged relative to the detent so that one of said single action cylinders pushes the detent from the inactive position to the active position, and another of said single action cylinders pushes the detent from the active position to the inactive position.

The connector assembly preferably includes a connector shaft having a proximal end that is adapted to engage the drive shaft, and a distal end that is adapted to engage an input shaft associated with the cutting head, the connector shaft being substantially aligned with the working axis. The distal end of the connector shaft is preferably formed with a socket for receiving the input shaft of the cutting head, and it is further preferred that the socket and the input shaft are adapted to facilitate radial alignment of the cutting head relative to the housing.

The connector assembly may be adapted to interact with a gearbox positioned between the input shaft and the cutting elements.

The connector assembly preferably includes an exhaust cavity that extends longitudinally of the housing from the proximal end to the distal end through which swarf can be removed when in use. Where a sealing arrangement is included, it is preferred that a sealing arrangement be provided at a proximal end of the housing associated with the exhaust cavity for impeding the egress of swarf between the proximal end of the housing and the distal end of the drill string.

The connector assembly preferably includes an imaging device located within the housing and being adapted for capturing images from in front of the distal end of the housing. The imaging device may take the form of a camera that can project images back to the operator.

The connector assembly preferably includes a pair of elongate members located at proximal end of the housing for interacting with a latch connection at a distal end the drill string each elongate member is adapted to be adjustable so as to vary the tolerance between proximal end of the housing and the distal end of the drill string.

According to another aspect of this invention there is provided a microtunneling apparatus including a drill string having a drive shaft that is rotatable about a working axis from a proximal end of the drill string, an operating line extending from the proximal end of the drill string along the length of the drill string, and a cutting head at a distal end of the drill string, the cutting head having a plurality of cutting elements for rotation with the drive shaft about the working axis and a plurality of locating elements spaced from the working axis, and a connector assembly including a housing with a proximal end adapted for location at distal end of the drill string, and a distal end of the housing being adapted to interact with the locating elements of the cutting head, a latch mechanism at the distal end of the housing which is spaced from the working axis, the latch mechanism that is connected to the operating line so as to be adjustable between a lock condition and a release condition from a proximal end of the drill string, so that in use the connector assembly engages cutter head when in the locked condition to move with the drill string and the connector assembly is disengaged from the cutting head when in the release condition to move the drill string relative to the cutting head.

The microtunneling apparatus preferably includes an imaging device located within the housing and being adapted for capturing images from in front of the distal end of the housing, and the cutting head includes a locating means for interaction with the imaging device for facilitating locating a rotational position of the cutting head relative to the housing. This arrangement facilitates remote connection to the cutting head with the apparatus is in use. The microtunneling apparatus preferably is adapted so that the operating line is connected to the imaging device so as to relay images of the locating means indicating the rotational position of the cutting head to an operator remote from the cutting head, however wireless communication with the imaging device may also be an option.

The microtunneling apparatus preferably includes an exhaust cavity that extends longitudinally of the housing from the proximal end to the distal end, the drill string having a casing with the drive shaft located therein for rotation about the working axis, a first cavity within the casing that extends longitudinally of the casing and offset from drive shaft for alignment with the exhaust cavity of the hosing and through which swarf can be removed when in use. It is further preferred to include a sealing arrangement at the proximal end of the housing associated with the exhaust cavity for impeding the egress of swarf between the proximal end of the housing and the distal end of the drill string.

The microtunneling apparatus preferably includes a pair of elongate members located at proximal end of the housing for interacting with a latch connection at a distal end the drill string each elongate member is adapted to be adjustable so as to vary the tolerance between proximal end of the housing and the distal end of the drill string.

The microtunneling apparatus preferably includes a connector shaft having a proximal end that is adapted to engage the drive shaft, and a distal end that is adapted to engage an input shaft associated with the cutting head, the connector shaft being substantially aligned with the working axis. The distal end of the connector shaft may be formed with a socket for receiving the input shaft of the cutting head, the input shaft having a tapered proximal end to facilitate radial alignment of the cutting head relative to the housing.

The microtunneling apparatus may include a gearbox between the input shaft and the cutting elements.

The microtunneling apparatus may also include an aperture for accommodating each said locating element of the cutting head, and a detent associated with each aperture for interacting with each locating element, each detent is adjustable between an active position and an inactive position which corresponds with the latch mechanism adopting the lock condition and release condition respectively. Each detent may be adapted to move linearly between the active position and the inactive position, the connecting apparatus may also include a hydraulic ram for each detent that is activated to move each detent between the inactive position and the active position.

The microtunneling apparatus may include the drill string being formed by a plurality of connected string segments each string segment including a latch connection for manually connecting adjacent string segments.

It will be convenient to hereinafter describe the invention in greater detail by reference to the attached illustrations of a preferred embodiment of the connector assembly according to the invention. The particularity of those illustrations, and the accompanying detailed description is not to be understood as superseding the generality of the preceding definition of the invention according to each of its aspects. Whilst some of the illustrations are provided in a vertical/portrait orientation it is to be understood that the microtunneling apparatus is intended for operation in a horizontal or substantially horizontal orientation. The illustrations are provided in the portrait vertical/portrait orientation to enhance the level of detail.

BRIEF DESCRIPTION OF DRAWINGS

In order that the invention may be more fully understood, some embodiments will now be described with reference to the Figures in which.

DETAILED DESCRIPTION

Figure 1:
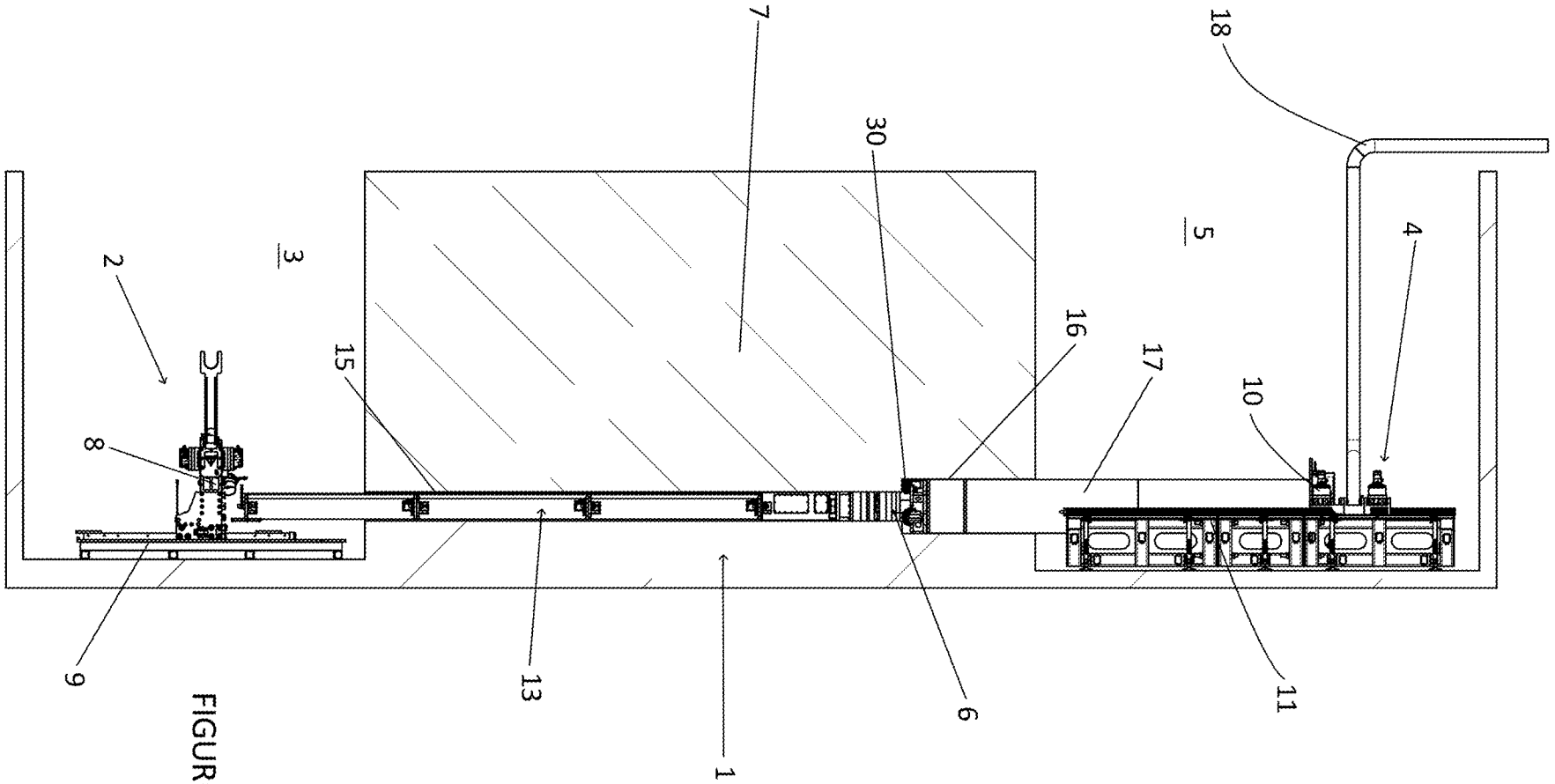
FIG. 1 is a side elevation view of an example of microtunneling apparatus including a preferred embodiment of a connector assembly according to the invention.

Referring now to FIG. 1 which illustrates an example of a microtunneling apparatus 1 when in use. The microtunneling apparatus 1 includes in summary, drive apparatus 2 in a drive pit 3, thrust apparatus 4 in a thrust pit 5 which both interact with a reamer assembly 6 positioned therebetween in the ground 7. The drive apparatus 2 includes a driver 8 positioned on a drive platform 9 which is movable there along. Similarly, the thrust apparatus 4 is illustrated as including a thrust mechanism 10 positioned on a thrust platform 11 for movement there along.

Figure 2:
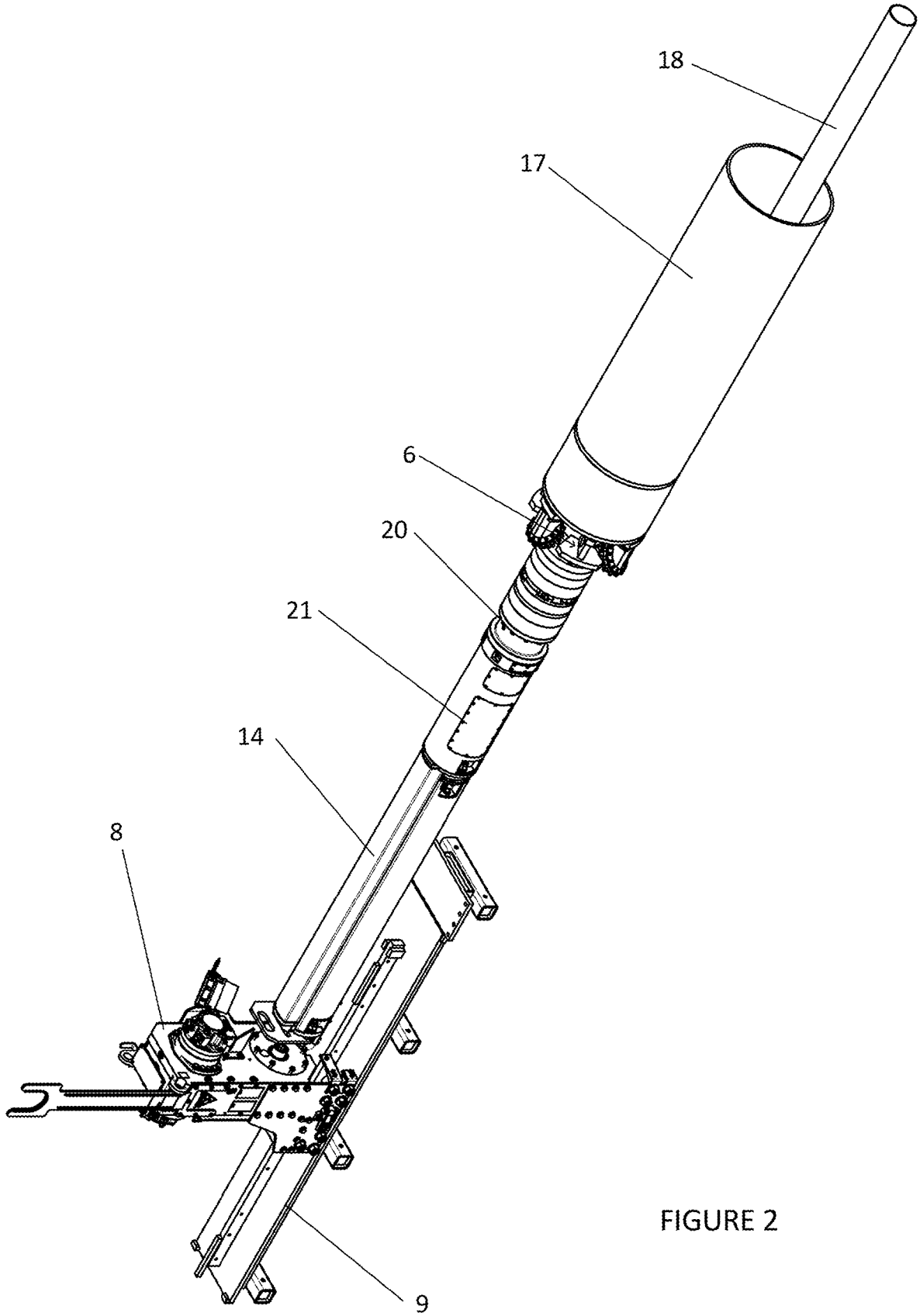
FIG. 2 is an isometric view of part of the microtunneling apparatus showing the connector assembly between the drill string and the cutting head.

It can be appreciated from FIG. 2 that the drive platform 9 includes a guide rail 12 for linearly guiding movement of the driver 8 there along. The drive apparatus 2 also includes a drill string 13 which is releasably attached to a front of the driver 8. It can be appreciated from FIG. 1 that the drill string 13 includes a plurality of drill string segments 14 and is configured to be locatable within a pilot hole 15 in the ground. The pilot hole 15 will be previously formed by attaching a drill head (not shown) to the leading end of the drill string 13 in a manner that will be understood by those skilled in the art. Throughout this specification the term pilot hole 15 refers to the portion of the micro tunnel between the reamer assembly 6 and the drive pit 3, while a bore hole 16 refers to the portion of the micro tunnel between the reamer assembly 6 and the thrust pit 5.

While FIG. 1 illustrates the drill string 13 having three drill string segments 14, this number may vary depending upon the length of the pilot hole 15. The features of each drill string segment 14 will be described in greater detail with reference to later illustrations. It ought to be appreciated from FIG. 1 that the length of the guide rail 12 on the drive platform 9 is longer than the length of the drill string segments 14. This arrangement allows the driver 8 to be moved towards the rear of the drive pit 3 and permit disconnection/attachment of each drill string segment 14 from the front of the driver 8 to shorten on lengthen the drill string 13.

The thrust platform 11 in FIG. 1 is illustrated supporting two pipe segments 17, which are designed to transfer thrust from a thrust mechanism 10 to the reamer assembly 6. Again, while FIG. 1 illustrates only two pipe segments 17, this number will vary depending upon the length of the bore hole 16. The thrust mechanism 10 also supports part of a vacuum conduit 18 through which spoil from the reamer assembly 6 passes, to be dispensed outside of the thrust pit 5.

Figure 3:
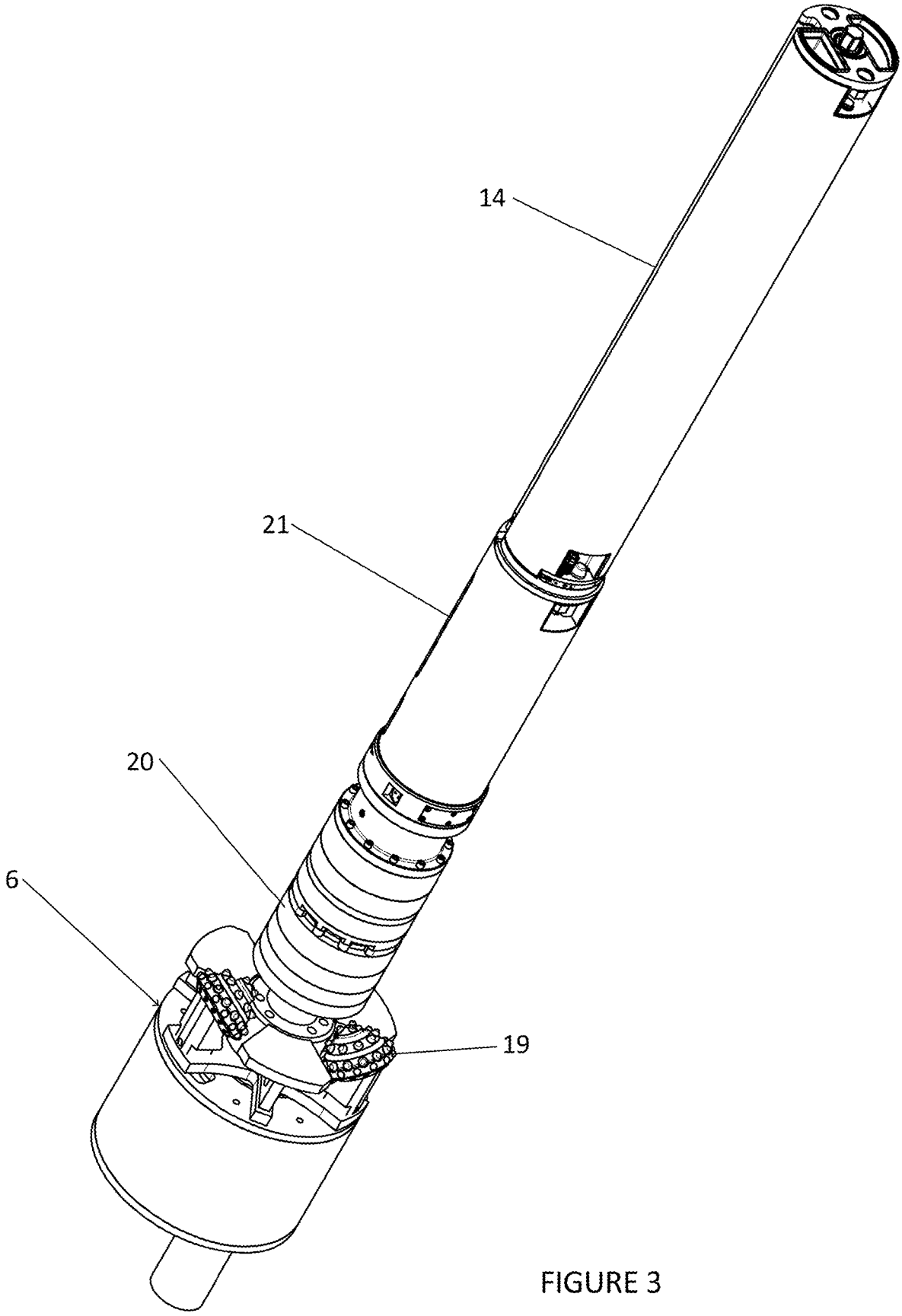
FIG. 3 is an isometric view of part of the microtunneling apparatus from a reverse perspective to that as shown in FIG. 2.

FIG. 2 illustrates a simplified form of the microtunneling apparatus 1 having only a single string segment 14 and a single pipe section 17. The reamer assembly 6 is more clearly illustrated in FIG. 3 and is one form of cutting head to which the invention applies. More specifically in its broader sense the invention applies to any cutting head having a plurality of cutting elements 19 which are rotatable about the longitudinal working axis. The preferred embodiment of the cutting head illustrated in FIG. 3 is the reamer assembly 6 which includes a gearbox 20. The function of the gear box is more clearly described in the Applicant's co-pending application 2022900836 for Microtunneling Apparatus, the entire contents of the specification of which is incorporated herein by reference FIG. 3 also illustrates a preferred embodiment of a connector assembly 21 according to the invention positioned between the gearbox 20 and the string segment 14. The connector assembly 21 will be described in greater detail by reference to latter illustrations.

Figure 4:
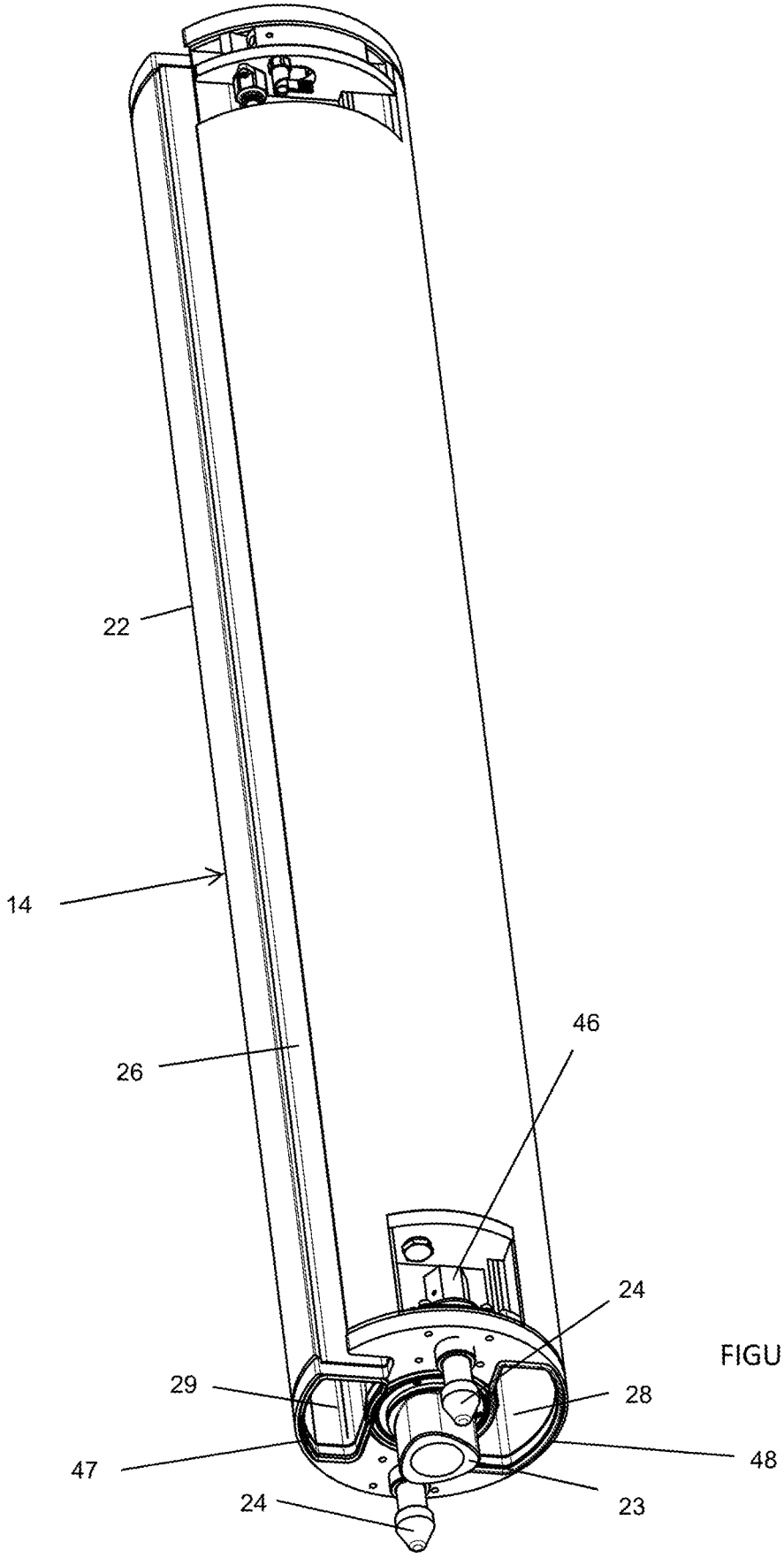
FIG. 4 is an isometric view of a segment of the drill string from FIG. 3.
Figure 5:
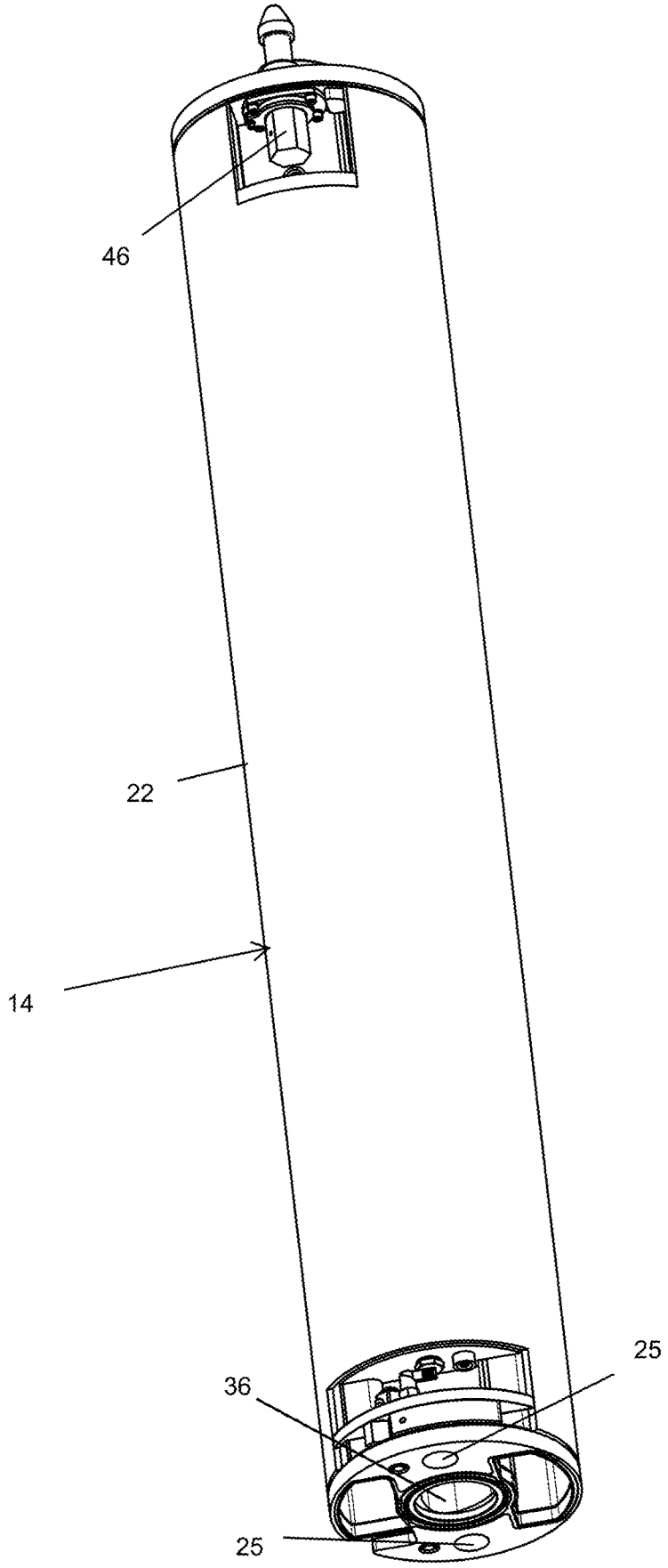
FIG. 5 is an isometric view of the segment of the drill section from a reverse perspective to that as illustrated in FIG. 4.

FIGS. 4 and 5 illustrate a preferred embodiment of the string segment 14 including an elongate housing 22 with a drive shaft 23 positioned for rotation about the longitudinal axis. FIG. 4 illustrates a pair of pins 24, referred to elsewhere as locating elements positioned radially of the drive shaft 23.

The pins 24 are adapted to locate within apertures 25 (see FIG. 5) at an opposite end of an adjacent string segment 14 so as to securely engage one string segment 14 to an adjacent string segment 14 to produce a drill string 13. Each of the pins 24 has a nut 46 located to the rear thereof that can be rotated to adjust the length of the pin 24 to tighten or loosen the engagement between string segments 14. The manner in which the string segments 14 engage is more clearly described in the Applicant's co-pending application No. 2022900836 for Microtunneling Apparatus, the entire contents of the specification of which is incorporated herein by reference.

It should be noted however from FIG. 4 that the housing includes an open channel 26 extending longitudinally thereof for accommodating cabling 45 (see FIG. 6) extending between the drive apparatus 2 and at least the connector assembly 21. The cabling may include hydraulic lines for the operation of the reamer assembly 26 supplying fluid to the cutting elements 21. Further communication cabling can be included to provide communications with the connector assembly 21 so as to connect for example an imaging device (see FIG. 7) with the drive apparatus 2 which enables an operator to access images between the connector assembly 21 and the reamer assembly 6. Other communication cabling may also be required for the operation of the reamer assembly 6. Whilst FIG. 6 only illustrates three cables, the channel 26 has room to accommodate additional cables 45 as required.

FIG. 4 also illustrates the housing 22 defining an exhaust conduit 28 located at a bottom of the housing, and a sighting conduit 29 positioned at an upper location of the housing 22. The exhaust conduit 28 is configured to facilitate extraction of swarf produced by the reamer assembly 2 during operation microtunneling apparatus 1 from a working face 30 (see FIG. 1) back to the drive apparatus 2. Whilst the sighting conduit 29 is adapted for laser sighting during operating of the microtunneling apparatus 1 to facilitate accurate alignment when producing the pilot hole 15. The manner in which the string segments 14 engage is more clearly described in the Applicant's co-pending application No. 2022900836 for Microtunneling Apparatus, the entire contents of the specification of which is incorporated herein by reference.

The sighting conduit 29 can also be useful during operation of the reamer assembly 6 to supply air under pressure along the drill string 13 towards the reamer assembly 6. In this way air is supplied in the sighting conduit 29 and extracted in the exhaust conduit 28 creating a circuit for the extraction of swarf. Supplying air under pressure in the sighting conduit 19 also helps in cooling the sighting conduit 19, which assists in maintaining accuracy of the laser (not shown). A laser can lose its accuracy when operated in a temperature variable environment.

FIG. 4 illustrates sealing elements 47, 48 surrounding the entry to the sighting conduit 29 and exhaust conduit 28 respectively. The sealing elements 47, 48 facilitate providing an airtight seal between the adjacent string segments 14, particularly to inhibit the egress of swarf out from the exhaust conduit 28. The manner in which the sealing elements 47, 48 function is more clearly described in the Applicant's co-pending application No. 2022900836 for Microtunneling Apparatus, the entire contents of the specification of which is incorporated herein by reference.

Figure 6:
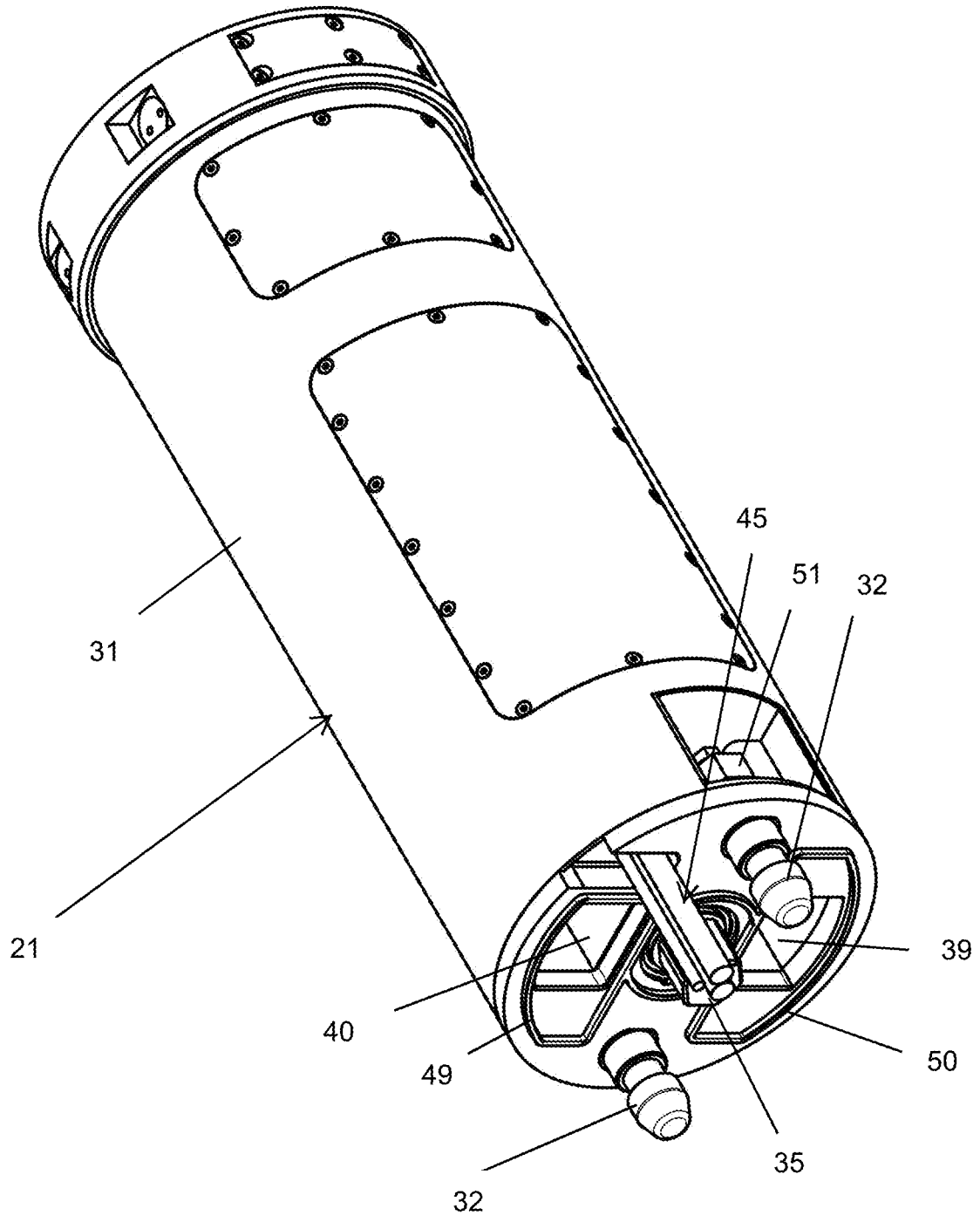
FIG. 6 is an isometric view of the connector assembly as shown in FIG. 2.
Figure 7:
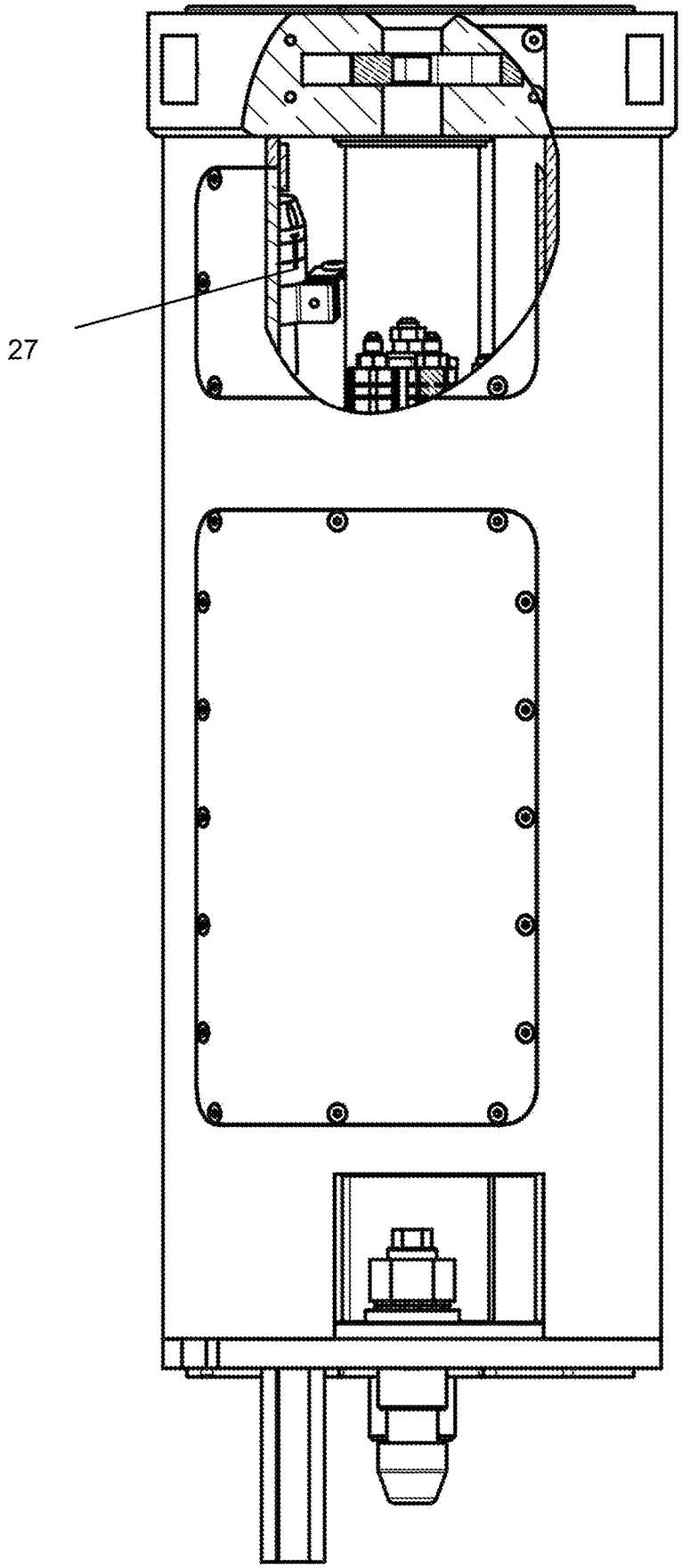
FIG. 7 is a side elevation view of the connector assembly from FIG. 6 showing a camera.
Figure 8:
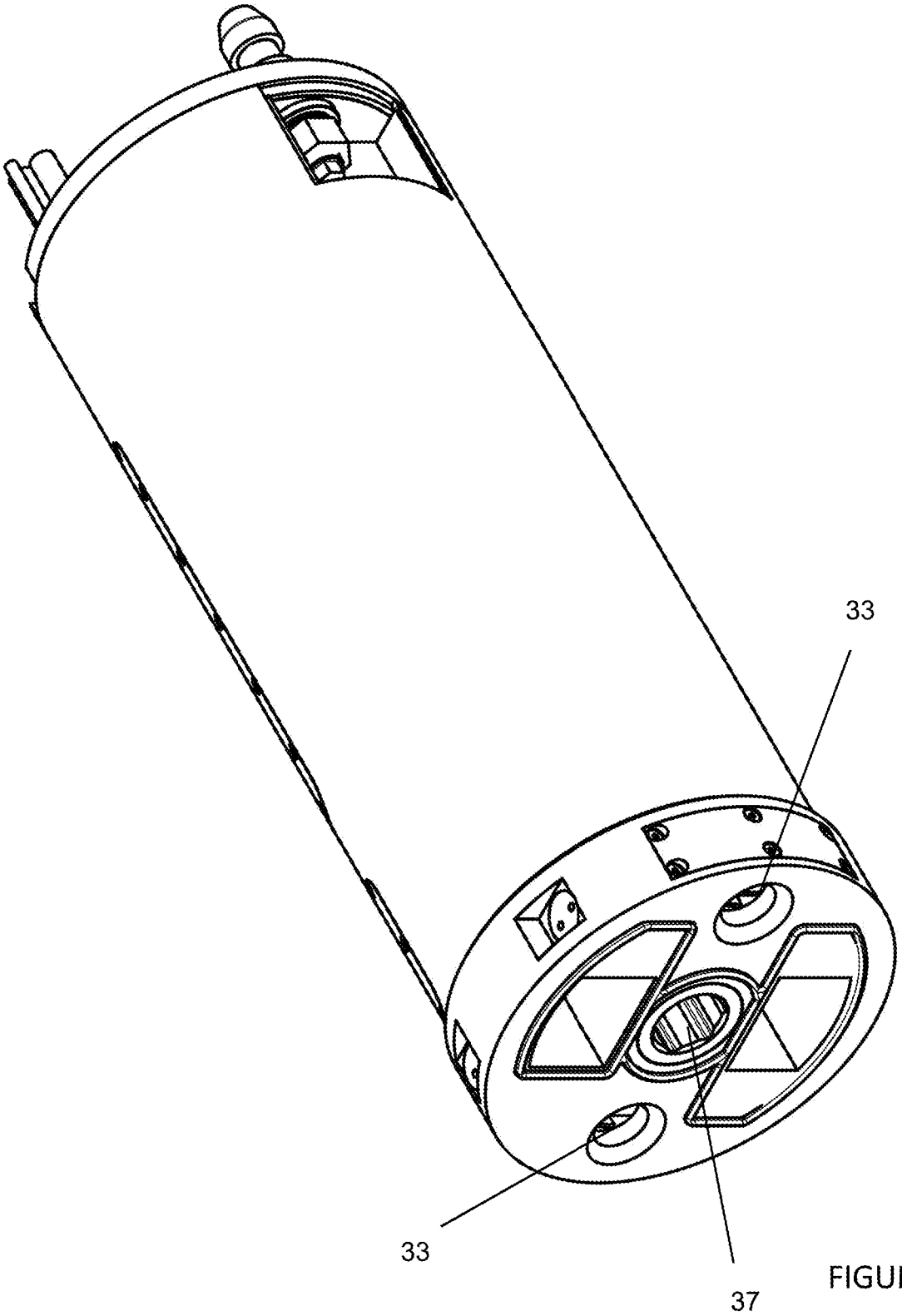
FIG. 8 is an isometric view of the connector assembly from FIG. 6 in a reverse perspective.
Figure 9:
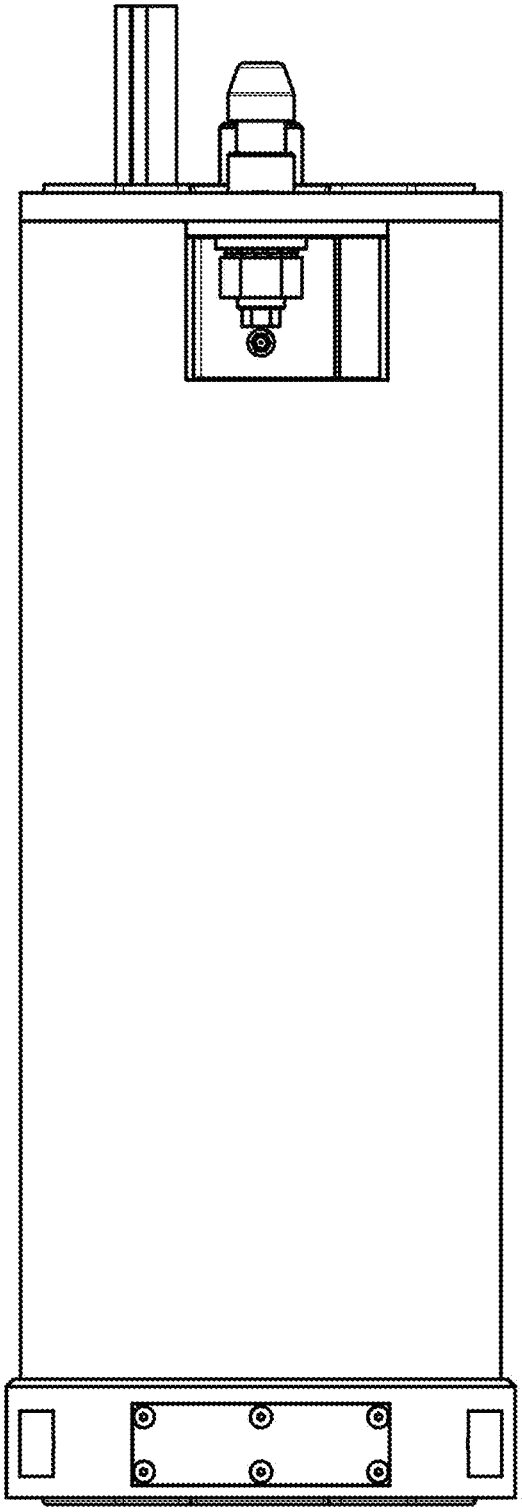
FIG. 9 is a side elevation view from an opposite side to that as shown in FIG. 7.

FIG. 6 illustrates a preferred embodiment of the connector assembly 21 shown from an end intended to engage the drill string 13. The connector assembly 21 includes a housing 31 having a pair of locating elements shown in the form of pins 32 adapted to locate within the apertures 25 (see FIG. 5). In contrast FIG. 8 illustrates the connector assembly 21 from a distal end thereof which has a pair of apertures 33 adapted to receive locating elements in the forms of pins 34 (see FIG. 10) extending from the gearbox 20 of the reamer assembly 6.

Figure 11:
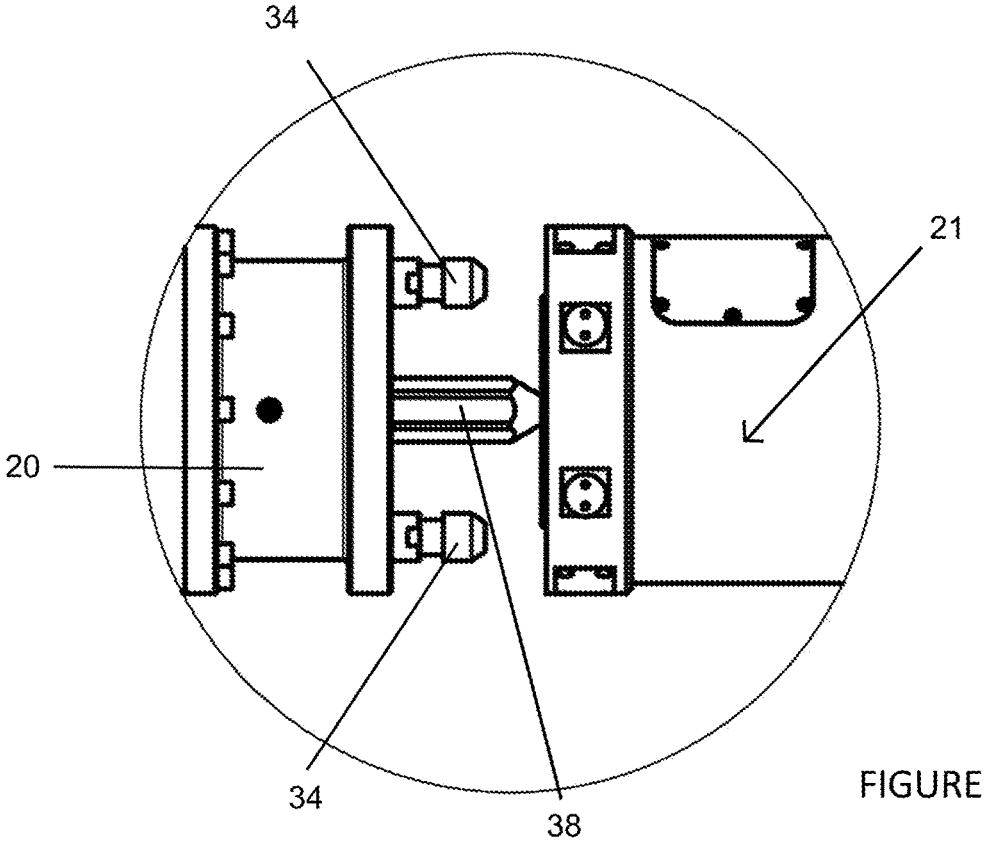
FIG. 11 is a detail view of the connector assembly spaced from the gearbox as shown in FIG. 10.

Referring again to FIG. 6 which illustrates a connector shaft 35 extending out a proximal end of the housing 31 which is adapted to locate within a socket 36 of the drive shaft 23 (see FIG. 5), such that the connector shaft 35 rotates with the drive shaft 23. The connector shaft 35 extends the length of the housing 31 and is formed with a socket 37 (see FIG. 8) at a distal end thereof. The socket 37 is configured to receive an input shaft 38 that extends from the gearbox 20, whereby rotation of the input shaft 38 results in rotation of the cutting elements 19 about the working axis. It can be appreciated from FIG. 11 that the input shaft 38 is tapered at its leading end so as to facilitate radial alignment of the distal end of the connector assembly 21 with the gearbox 20 during attachments therebetween.

Referring again to FIG. 6 which illustrates the connector assembly 21 includes an exhaust conduit 39 and a sighting conduit 40 which align with the exhaust conduit 28 and sighting conduit 29 in the string segment 14 (see FIG. 4) when the connector assembly 21 is attached to the string segment 14. In this way the exhaust conduit 39 provides a pathway through which swarf produced by the reamer assembly can be retracted back to the drive pit 3.

FIG. 6 also illustrates sealing elements 49, 50 at the entrance to the sighting conduit 40 and exhaust conduit 39 respectively. A nut 51 is also visible that interacts with the pins 32 in the same manner as the nut 46 and pins 24 described with refence to FIG. 4.

Figure 10:
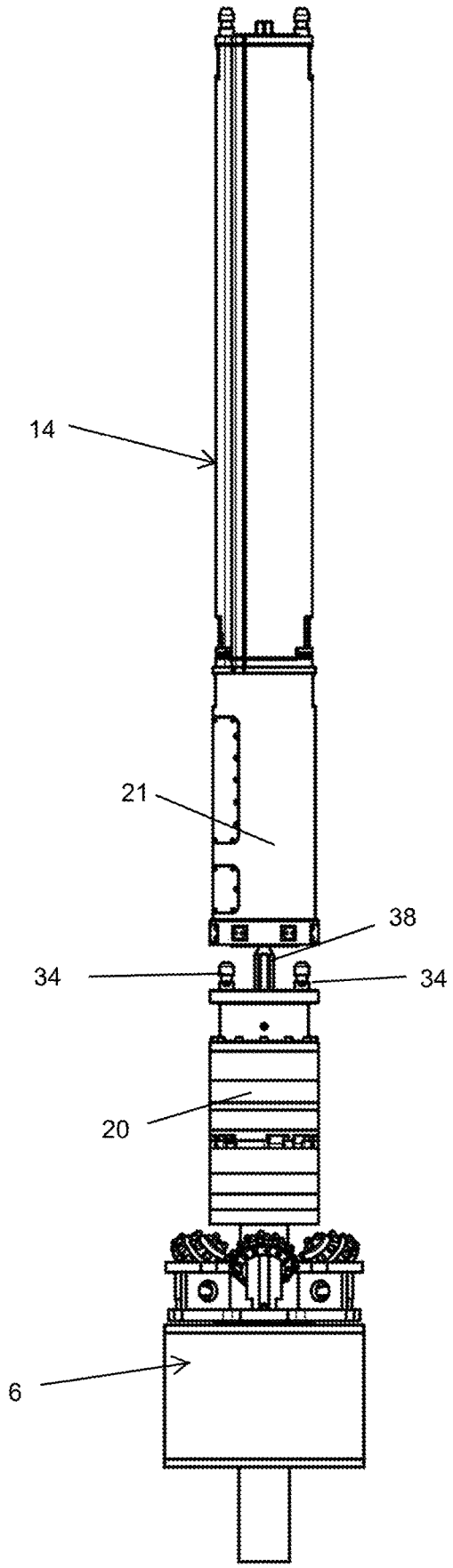
FIG. 10 is a side elevation view of the microtunneling apparatus as shown in FIG. 3 with the connector assembly spaced from the gearbox.
Figure 12:
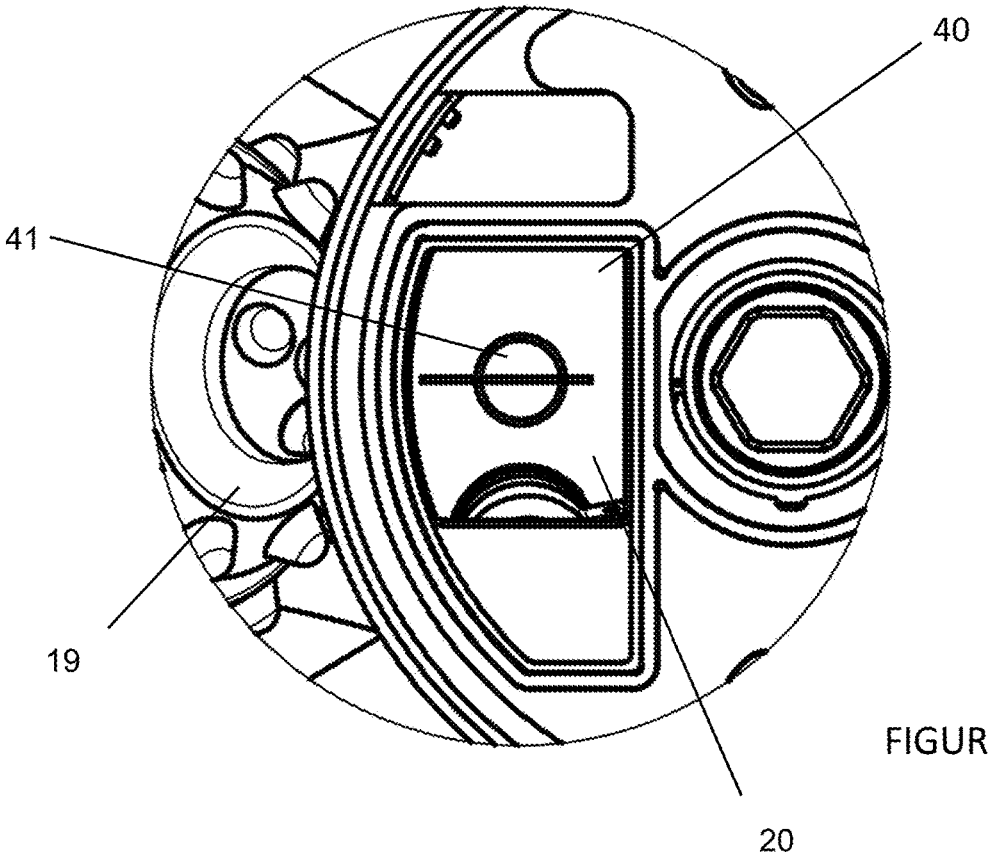
FIG. 12 is a parts cross sectional view of the connector assembly engaging the gearbox.
Figure 14:
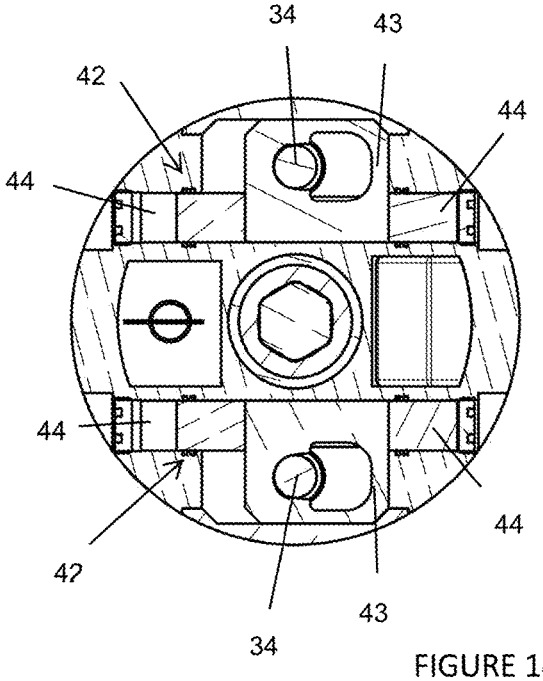
FIG. 14 is a cross sectional view of the latch mechanism in a lock condition so as to secure the connector assembly to the gearbox.
Figure 15:
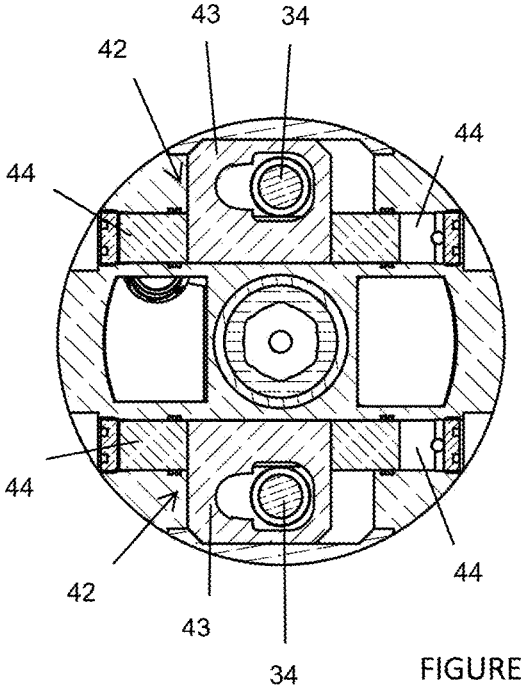
FIG. 15 is a cross sectional view of the latch mechanism in a release condition.
Figure 13:
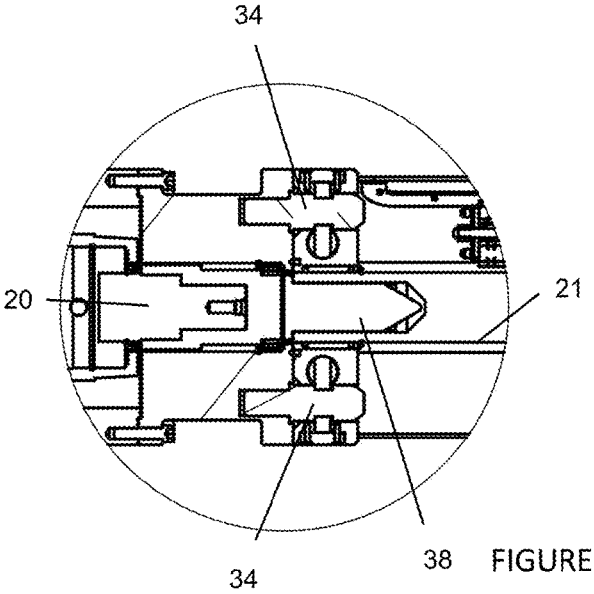
FIG. 13 is a long sectional view of the connector assembly engaging the gearbox.

The attachment of the connector assembly 21 to the gearbox 20 will now be described generally with reference to FIGS. 10 to 15. FIG. 10 shows the connector assembly 21 positioned adjacent the gearbox 20 with the input shaft 38 just entering the socket 37 (see FIG. 8). This facilitates the radial alignment of the connector assembly 21 with the gearbox 20 however it does not ensure that the pins 34 are rotationally aligned with the apertures 33. In this regard the imaging device 27 (see FIG. 7) and the sighting conduit 40 enable identification of a locating means 41 on the gearbox 20 to be identified. Where the operator can discern that there is a misalignment between the laser sight and locating means 41, the drive shaft 23 can be rotated in a clockwise or anti-clockwise direction that will result in the housing 31 rotating in an opposite direction so as to align with the locating means 41. Thereafter the drive apparatus 2 can operate to complete the engagement of the connector assembly 21 with the gearbox 20. The connector assembly 21 includes a latch mechanism 42 (see FIG. 14). The latch mechanism 42 includes a pair of detents 43 that are linearly adjustable between an active position as shown in FIG. 14 and an inactive position as shown in FIG. 15 in which the detents 43 lock onto the pins 34 or release the pins 34 respectively. The latch mechanism may move the detents 43 in any suitable manner, and in the preferred arrangement illustrated the detents 43 are moved by hydraulic rams 44 positioned on either side of the detents 43. The rams 44 are operationally connected to the drive apparatus 2 by way of the cabling such that their operation can be achieved remote from the working face.

It ought to be appreciated from the foregoing that connector assembly 21 as hereinbefore described enables remote release of the reamer assembly 6 so as to enable the operator to problem solve any issues that may arise at the working face. This can include where the drive shaft 23 suffers a failure, or where jacking pressures increase unexplainably.

Various alterations and/or additions may be introduced into the reamer assembly as hereinbefore described without departing from the spirit or ambit of the invention.

What is claimed is:

1. A connector assembly for use with microtunneling apparatus including a drill string having a drive shaft that is rotatable about a working axis from a proximal end of the drill string, an operating line extending from the proximal end of the drill string along the length of the drill string, and a cutting head at a distal end of the drill string, the cutting head having a plurality of cutting elements for rotation with the drive shaft about the working axis and a plurality of locating elements spaced from the working axis, the connector assembly including a housing with a proximal end adapted for location at distal end of the drill string, and a distal end of the housing being adapted to interact with the locating elements of the cutting head, a latch mechanism at the distal end of the housing which is spaced from the working axis, the latch mechanism for connection to the operating line so as to be adjustable between a lock condition and a release condition from a proximal end of the drill string, so that in use the connector assembly engages cutter head when in the locked condition to move with the drill string and the connector assembly is disengaged from the cutting head when in the release condition to move the drill string relative to the cutting head, wherein the connector assembly further includes an aperture for accommodating each said locating element of the cutting head, and a detent associated with each aperture for interacting with each locating element, each detent is adjustable between an active position and an inactive position which corresponds with the latch mechanism adopting the lock condition and release condition respectively, wherein each detent is adapted to move linearly between the active position and the inactive position, wherein the connector assembly further includes a hydraulic ram for each detent that is activated to move each detent between the inactive position and the active position, and wherein each hydraulic ram includes two single-action cylinders, each single action cylinder being operable to push the detent only and being arranged relative to the detent so that one of said single action cylinders pushes the detent from the inactive position to the active position, and another of said single action cylinders pushes the detent from the active position to the inactive position.

2. A connector assembly according to claim 1 including a connector shaft having a proximal end that is adapted to engage the drive shaft, and a distal end that is adapted to engage an input shaft associated with the cutting head, the connector shaft being substantially aligned with the working axis.

3. A connector assembly according to claim 2 wherein the distal end of the connector shaft is formed with a socket for receiving the input shaft of the cutting head.

4. A connector assembly according to claim 3 wherein the socket and the input shaft are adapted to facilitate radial alignment of the cutting head relative to the housing.

5. A connector assembly according to claim 4 including a gearbox between the input shaft and the cutting elements.

6. A connector assembly according to claim 1 including an exhaust cavity that extends longitudinally of the housing from the proximal end to the distal end through which swarf can be removed when in use.

7. A connector assembly according to claim 6 including a sealing arrangement at a proximal end of the housing associated with the exhaust cavity for impeding the egress of swarf between the proximal end of the housing and the distal end of the drill string.

8. A connector assembly according to claim 1 including an imaging device located within the housing and being adapted for capturing images from in front of the distal end of the housing.

9. A connector assembly according to claim 1 including a pair of pins located at proximal end of the housing for interacting with a latch connection at a distal end the drill string each pin is adapted to be adjustable so as to vary the tolerance between proximal end of the housing and the distal end of the drill string.

* * * * *